US006639364B1

(12) United States Patent
Woods et al.

(10) Patent No.: US 6,639,364 B1
(45) Date of Patent: Oct. 28, 2003

(54) HALOGEN INCANDESCENT CAPSULE HAVING FILAMENT LEG CLAMPED IN PRESS SEAL

(75) Inventors: Joseph P. Woods, Hammondsport, NY (US); Eswara V. Vallabhaneni, Elmira, NY (US); Winand H. A. M. Friederichs, Bath, NY (US); Mary E. Fortuna, Canisteo, NY (US); Karl Baker, New York, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 372 days.

(21) Appl. No.: 09/606,396

(22) Filed: Jun. 29, 2000

(51) Int. Cl.[7] ..... H01K 1/18; H01K 1/40

(52) U.S. Cl. ..... 313/625; 313/626; 313/578

(58) Field of Search ..... 313/623, 625, 313/626, 628, 574, 576, 578, 579, 580, 557, 559, 569, 271, 333; 445/27

(56) References Cited

U.S. PATENT DOCUMENTS

| | | | | | |
|---|---|---|---|---|---|
| 1,715,580 | A | | 6/1929 | Turner | |
| 2,145,186 | A | * | 1/1939 | Meeker et al. | 313/333 |
| 3,211,942 | A | | 10/1965 | Willey | 313/315 |
| 3,211,943 | A | * | 10/1965 | Cardwell, Jr. | 313/274 |
| 3,211,950 | A | | 10/1965 | Cardwell | 315/74 |
| 3,254,257 | A | * | 5/1966 | Hoeh | 313/237 |
| 4,132,922 | A | | 1/1979 | Newton et al. | 315/17 |
| 4,354,137 | A | * | 10/1982 | Martin et al. | 29/611 |
| 4,451,760 | A | * | 5/1984 | Griffin et al. | 313/557 |
| 4,661,739 | A | * | 4/1987 | Dvorak et al. | 313/333 |
| 4,812,710 | A | * | 3/1989 | Klam et al. | 313/271 |
| 4,918,353 | A | * | 4/1990 | Nelson et al. | 313/113 |
| 5,034,656 | A | * | 7/1991 | Yu et al. | 313/579 |
| 5,680,003 | A | * | 10/1997 | Hartwick et al. | 313/271 |
| 5,760,543 | A | * | 6/1998 | Gmeiner | 313/271 |
| 5,982,078 | A | * | 11/1999 | Krisl et al. | 313/112 |
| 6,160,341 | A | * | 12/2000 | Binder et al. | 313/113 |
| 6,384,530 | B1 | * | 5/2002 | Yu et al. | 313/579 |

FOREIGN PATENT DOCUMENTS

| | | | |
|---|---|---|---|
| EP | 0108448 A1 | 5/1984 | H01K/1/66 |
| EP | 0108449 A1 | 5/1984 | H01K/1/66 |
| GB | 2139417 A | 11/1984 | H01K/1/40 |
| JP | 4138654 | 4/1992 | H01K/1/18 |
| WO | WO9960604 | 11/1999 | H01K/1/16 |

* cited by examiner

*Primary Examiner*—Nimeshkumar D. Patel
*Assistant Examiner*—Karabi Guharay
(74) *Attorney, Agent, or Firm*—Dicran Halajian

(57) ABSTRACT

A hard-glass halogen gas-filled incandescent capsule with a single-end or a double-end has a tungsten filament with a primary coil extending from the barrel into the legs, and a secondary coil forming the barrel. One of the legs of the tungsten filament of the single-ended capsule extends into a pinch or press seal of the glass envelope to result in passive extinction of the electric arc at end-of-life. The end of the filament leg near the press seal may be connected to and/or supported by a molybdenum lead wire of the capsule that is within the pinch or the press seal via a clamp formed on the molybdenum lead wire. The passive extinction occurs when the electric arc is conducted through the filament extending into the press seal. Reliable extinction of the arc within the capsule is achieved with simplicity in construction and minimal materials. The primary coil is preferably stretched out to assume the diameter of the tungsten wire where it is embedded in a pinch seal. This hastens extinction of the arc at end of life and also simplifies manufacture by eliminating close tolerance requirements in the clamp.

20 Claims, 3 Drawing Sheets

HALOGEN INCANDESCENT CAPSULE HAVING FILAMENT LEG CLAMPED IN PRESS SEAL

BACKGROUND OF THE INVENTION

1. Field of the Invention

The invention relates to a halogen incandescent capsule having a light-transmitting envelope which encloses a sealed cavity with a pinch at one end, and a filament having a pair of legs and a central barrel enclosed within the sealed cavity. The ends or legs of the filament are attached to a pair of lead wires which are sealed in the pinch. The lead wires extend out of the sealed cavity from the pinch. More particularly, the invention relates to a capsule having a filament with a primary coil and a secondary coil, where the primary coil ends form the legs for attachment to the leads.

2. Discussion of the Prior Art

FIG. 1 shows a known halogen incandescent capsule having a tungsten filament 10 with a barrel 16 between a pair of tungsten legs 18, and a "double ended" quartz envelope 20, with a pinch 22 at each end. The barrel 16 is located in a central cavity 24, and the coil legs 18 extend into the pinches 22 and are each welded to one end of a molybdenum foil 26. Molybdenum leads 28 are welded to the other end of the respective molybdenum foils 26 and extend out of the pinches 22.

To facilitate welding of the tungsten coiled legs 18 to the molybdenum foils 26, a small metal foil (platinum) 26A may be placed between the tungsten coil legs 18 and the molybdenum foil 26. The pinch 22 contains the molybdenum foil 26, the platinum foil 26A, as well as the ends of the respective tungsten coil legs 18 and molybdenum leads 28. The molybdenum foil is required in quartz envelopes 20 to create a gas-tight seal in the pinch 22 over the operating temperatures of the capsule.

FIG. 2 shows a conventional single-ended hard-glass capsule with a hard-glass envelope 30 and a pinch 32 at one end. Short and long molybdenum leads 36, 38 pass through the pinch 32. The short lead 36 is attached to one of the coil legs 18 typically with a clamp 37 formed in the molybdenum lead 36. The long lead 38 is attached to the coil leg 18 via clamp 39, for example. According to this known construction, both of the clamps 37, 39 as well as the entire tungsten filament 10 are located in the sealed cavity 34. The coefficient of thermal expansion of the hard-glass matches that of molybdenum eliminating the requirement of the molybdenum foils 26 shown in FIG. 1. Addition of molybdenum to the interior of the cavity 34 may require modification of the halogen chemistry to attenuate transport of molybdenum from the lead to the bulb wall.

FIG. 3 shows the filament 10 used in the halogen capsules shown in FIGS. 1 and 2. The coiled-coil filament 10 has a primary coil 14 and a secondary coil 16. The filament 10 is formed with a tungsten wire 12 wound on a primary mandrel having a diameter on the order of 80–150 $\mu$m to form the primary coil 14 having an external diameter on the order of 100–300 $\mu$m. The primary coil 14 is wound on a secondary mandrel having a diameter on the order of 300–800 $\mu$m to form the secondary coil 16 which forms the barrel 16. The secondary mandrel is retracted or dissolved, and the primary mandrel is then removed in whole or in part by dissolving. U.S. Pat. No. 4,132,922 discloses a double-ended capsule having a so-called retained mandrel coil.

Double-ended quartz capsules are marketed in thin-glass outers, such as blown glass reflectors, decorative outers and the like for general lighting applications. Single-ended hard-glass capsules are marketed in thick-glass outers such as parabolic aluminized reflector (PAR) lamps and transmissive bulbs for general lighting. Double-ended quartz capsules with coil legs 18 extending into the press or pinch 22, as shown in FIG. 1, have passive extinction of electric arc at end-of-life. Elimination of non-passive failures in hard-glass halogen burners will enable marketing of thin-glass outer lamps containing the hard-glass burner.

SUMMARY OF THE INVENTION

It is an object of the invention to provide a halogen incandescent capsule in hard-glass which passively extinguishes arcing which occurs at end-of-life, with a simple and economic construction.

According to the invention, this and other objects are achieved by a halogen incandescent capsule with a hard-glass envelope having at least one pinch seal at one end thereof and containing a filament, e.g. a tungsten filament. At least one leg of the filament extends into the pinch seal and is attached to a lead, e.g., a molybdenum lead, in the pinch seal.

When the filament fails at end-of-life, the arc is extinguished passively with disintegration of the filament leg in the cavity and near the inside surface of the pinch seal.

According to a further aspect of the invention, the filament has a primary coil, where the primary coil of the filament leg is modified so that the leg portion in the pinch is straight or has an increased pitch. The modified, e.g., stretched, coil leg reduces the extinction time and electric arc energy at the end-of-life due to reduced linear wire density near the pinch.

Modifying, e.g., stretching out, the coil leg enables a robust clamping of the tungsten wire in the molybdenum clamp with complete closure of the clamp. This eliminates clamping on the primary winding which requires a tight tolerance gap within the molybdenum clamp, which in turn, eliminates strain in the clamped leg and fractures of the coil leg. Clamping on the modified coil leg negates the requirement of changeover time between wattages at the mount machine.

For this reason, it is advantageous to modify both coil legs where they are clamped, whether or not the clamps are located in a press seal.

DESCRIPTION OF THE PREFERRED EMBODIMENTS

Figure 1:
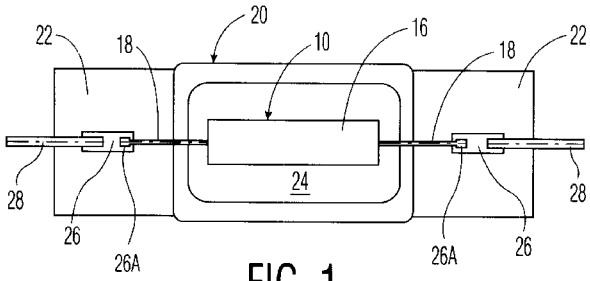
FIG. 1 PRIOR ART
FIG. 1 shows a double-ended quartz capsule with foils in the pinches (prior art)
Figure 2:
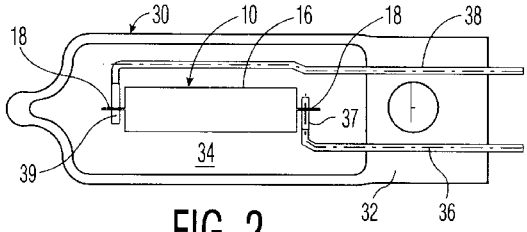
FIG. 2 PRIOR ART
FIG. 2 shows a single-ended hard-glass capsule having wire leads with clamps in the cavity (prior art)
Figure 3:
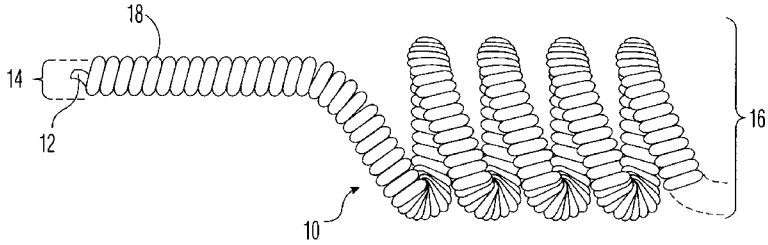
FIG. 3 PRIOR ART
FIG. 3 shows a double-coil filament (prior art)
Figure 4:
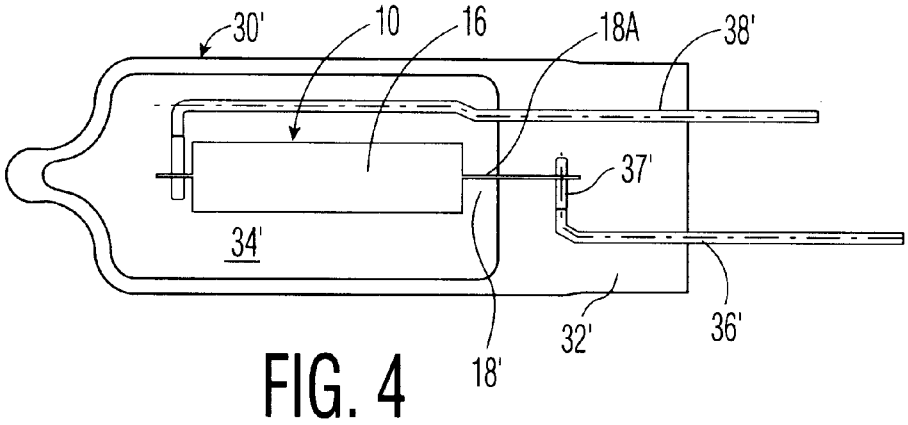
FIG. 4 shows a single-ended hard-glass capsule having a clamp located in the pinch according to the present invention.

FIG. 4 shows a single-ended capsule having a hard-glass envelope 30', a pinch 32', and a cavity 34'. The cavity 34' is filled with an inert gas containing halogen. This single-ended capsule is similar to the embodiment of FIG. 2, except that the filament leg 18' has a leg portion 18A extending into the pinch 32'. This leg portion 18A is connected to the short lead 36' in the pinch 32' at location 37' of the short lead 36', which is a clamp 37' for example. The short lead 36' and the long lead 38' are current supply leads and are both sealed in the hard-glass pinch 32'. According to a preferred embodiment, as discussed in conjunction with FIG. 7, the primary coil 14 of the filament 10 is modified, e.g., stretched out, so that the diameter of the leg 18' or leg portion 18A is reduced to nearly the diameter of the tungsten wire 12 in the pinch 32.

Figure 5:
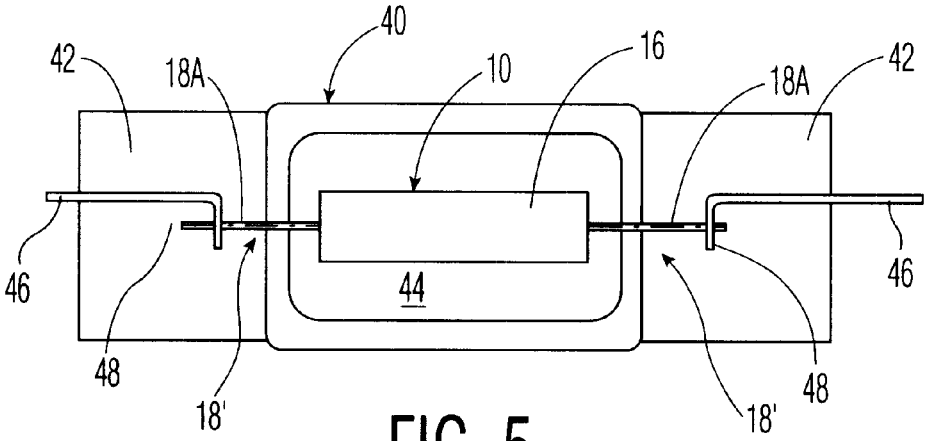
FIG. 5 shows a double-ended hard-glass capsule having clamps located in the pinches according to the present invention.

FIG. 5 shows a double-ended capsule having a hard-glass envelope 40 with a pair of opposed pinches 42 and a sealed cavity 44 containing the secondary coil or barrel 16 of the filament 10. Each leg 18' extends into a respective pinch 42 where each leg portion 18A is attached, e.g., clamped, to location 48, e.g., clamp 48, of the lead wire 46. Illustratively, the current supply lead wires shown in FIG. 4 as numerals 36', 38' and in FIG. 5 as numeral 46, and respective clamps 37', 48 are molybdenum. This construction assures passive extinction of end-of-life arcing when at least one of the leg portions 18A in the pinches 42 disintegrates. As discussed in conjunction with FIG. 7, the primary coil 14 is modified such that the leg diameter is reduced to nearly the diameter of the tungsten wire 12.

Figure 6:
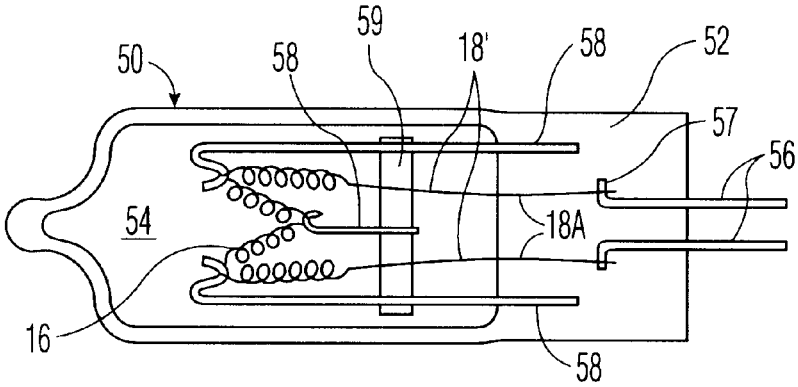
FIG. 6 shows a single-ended high voltage hard-glass capsule having clamps in the pinch according to the present invention.

FIG. 6 shows a single-ended capsule having a hard-glass envelope 50, a pinch 52, and a sealed cavity 54. Here both filament legs 18' are attached, e.g., clamped, to the leads 56 at portions 57, e.g., clamps 57, of the leads in the same pinch 52. The secondary coil is mounted in an "M" shape, but is not limited to this "M" shape, such that the filament barrel 16 can be mounted in a smaller cavity 54 or to accommodate longer barrel lengths. This makes the capsule suitable for high voltage (230V) applications or redesigned (longer barrel) 120V applications. The secondary coil 16 is mounted on isolated supports 58, where the center support is connected to two outer supports by a strap 59. Here too it is preferable for the tungsten filament legs 18' to be modified where they enter the pinch 52, as shown in greater detail in FIG. 7.

Figure 7:
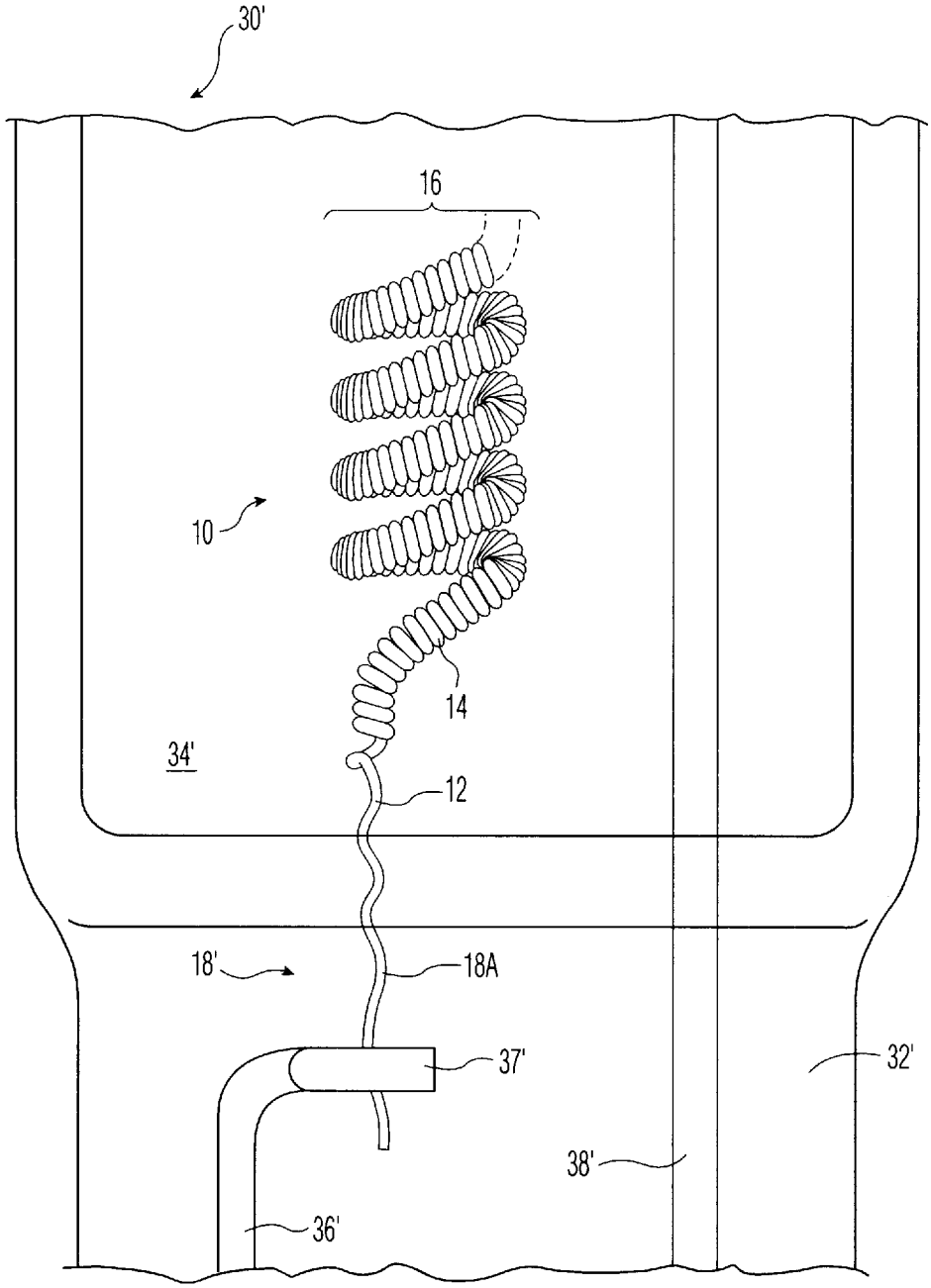
FIG. 7 shows a coiled-coil filament with a modified coil leg and molybdenum clamp in the pinch according to the present invention.

FIG. 7 shows a preferred embodiment of the single-ended capsule shown in FIG. 4, having a hard-glass envelope 30' with the single pinch seal 32' and the cavity 34. The tungsten filament has a primary coil 14 and a secondary coil 16, but here the primary coil 14 is modified, e.g., stretched out, to assume nearly the diameter of the tungsten wire 12, to form the lead wire 18'. The short lead 36' is attached in the pinch 32' to the modified tungsten lead wire portion 18A, e.g., via the clamp 37'.

The modified primary coil 14 in the legs 18', shown for example in FIGS. 4–6, simplifies manufacture by obviating close tolerances in the clamps 37', 48, 57 and hastens the extinction of the end-of-life arc by virtue of reduced linear wire density at the pinch 32', 42, 52.

The foregoing is exemplary and not intended to limit the scope of the claims which follow.

What is claimed is:

1. A halogen incandescent capsule comprising:

a light-transmitting capsule envelope which encloses a sealed cavity, said envelope having at least one end which is formed by a pinch, an inert gas containing halogen in said cavity, a tungsten filament having a pair of legs and a barrel portion therebetween, said barrel portion being arranged in said cavity, at least one of said pair of legs extending substantially non-linearly beyond one end of said barrel portion and into said pinch, and a pair of current supply wires extending into said pinch, at least one of said supply wires having a uniform size in said pinch and being attached at said pinch to a portion of the at least one of said pair of legs substantially extending non-linearly beyond one end of said barrel portion.

2. The halogen incandescent capsule of claim 1, wherein said pair of current supply wires each are formed with a clamp which is clamped to a respective one of said legs, at least one of said clamps and said portion of the at least one of said legs being located in said pinch.

3. The halogen incandescent capsule of claim 1, wherein said capsule envelope is hard-glass.

4. The halogen incandescent capsule of claim 1, wherein said supply wires are molybdenum.

5. The halogen incandescent capsule of claim 1, wherein said capsule envelope has a pair of opposed ends with a pinch at each end, each of said supply wires extending into a respective said pinch.

6. The halogen incandescent capsule of claim 5, wherein said supply wires each are formed with a clamp located in a respective said pinch, each said clamp is clamped to a respective one of said legs.

7. The halogen incandescent capsule of claim 1, wherein one of said current supply wires extends into said envelope.

8. The halogen incandescent capsule of claim 2, wherein both of said clamps are located in said pinch.

9. The halogen incandescent capsule of claim 1, wherein one of said wires is a long lead which is attached to one of said pair of legs remote from said pinch, said filament being supported by said long lead and said pinch.

10. The halogen incandescent capsule of claim 1, further comprising filament supports extending through said pinch, said supports supporting said filament between said pair of legs.

11. The halogen incandescent capsule of claim 1, wherein said tungsten filament is a tungsten wire formed as a primary coil extending through said barrel portion to form said pair of legs, and a secondary coil forming said barrel portion.

12. The halogen incandescent capsule of claim 11, wherein the primary coil of the pair of legs in the pinch is stretched so that at least one clamp attached to one of the current supply wires in the pinch is closed to the diameter of the tungsten wire.

13. The halogen incandescent capsule of claim 11, wherein said capsule envelope has a pair of opposed ends with said pinch at each end and a clamp in each said pinch, the primary coil of said pair of legs being stretched so that each said clamp in each said pinch is closed to the diameter of the tungsten wire.

14. The halogen incandescent capsule of claim 11, wherein the primary coil of each said pair of legs in the pinch is stretched out to assume essentially the diameter of the tungsten wire throughout the pinch.

15. The halogen incandescent capsule of claim 14, wherein said envelope has a pair of opposed ends, each of said pair of opposed ends having said pinch and said clamp in each said pinch.

16. The halogen incandescent capsule of claim 15, wherein the primary coil is stretched out to assume essentially the diameter of the tungsten wire throughout the portions of the legs in the pinches.

17. A halogen incandescent capsule comprising:

a hard-glass envelope which encloses a sealed cavity, said envelope having at least one end which is firmed by a pinch, an inert gas containing halogen in said cavity, a tungsten filament having a pair of legs extending substantially non-linearly in opposite directions therefrom and a barrel portion therebetween, said barrel portion being a tungsten wire formed as a primary coil extending through said barrel portion and into said pair of legs, and a secondary coil forming said barrel portion, and a pair of molybdenum current supply wires extending into said envelope, said supply wires each being formed with a clamp which is clamped to a respective one of said pair of legs, at least one of said clamps and a portion of at least one of said pair of legs being located in said pinch, wherein said pair of molybdenum current supply wires has a uniform size in said cinch.

18. The halogen incandescent capsule of claim 17, wherein the primary coil is stretched out to assume essentially the diameter of the tungsten wire throughout the portion of the pair of legs in the pinch.

19. A lamp comprising:

a light-transmitting envelope which encloses a sealed cavity, said envelope having at least one end which is formed by a pinch;

a filament having a pair of legs extending substantially non-linearly in opposite directions therefrom and a barrel portion therebetween, said barrel portion being arranged in said cavity; and a pair of wires extending into said pinch, at least one of said wires being attached to a portion of at least one of said pair of legs at said pitch and having a uniform size in said pinch.

20. The lamp of claim 19, further comprising a clamp located in said pinch, said clamp clamping said portion of at least one of said pair of legs to said at least one of said wires.

* * * * *